United States Patent [19]

Podell et al.

[11] Patent Number: 4,800,345

[45] Date of Patent: Jan. 24, 1989

[54] SPIRAL HYBRID COUPLER

[75] Inventors: Allen F. Podell, Palo Alto; Robert H. Benton, Mountain View, both of Calif.

[73] Assignee: Pacific Monolithics, Sunnyvale, Calif.

[21] Appl. No.: 154,640

[22] Filed: Feb. 9, 1988

[51] Int. Cl.[4] ..... H01P 5/18

[52] U.S. Cl. ..... 333/111; 333/116

[58] Field of Search ..... 333/111, 116

[56] References Cited

U.S. PATENT DOCUMENTS 3,162,717 12/1964 Lentz .
3,332,039 7/1967 Oh .
3,516,024 6/1970 Lange .
4,636,754 1/1987 Presser et al. .

OTHER PUBLICATIONS

Lange, "Interdigitated Strip-Line Quadrature Hybrid" *MTTS Digest of Technical Papers*, pp. 10–13, May 5, 1969, U.S. Pat. No. 3,516,024.

Kemp et al., "Ultra-Wide Band Quadrature Coupler," *Electronics Letters*, vol. 19, No. 6, pp. 197–199, Mar. 17, 1983, U.S. Pat. No. 3,516,024.

Shibata, et al., "Microstrip Spiral Directional Coupler," *IEEE Transations on Microwave Theories and Techniques*, vol. MTT29, No. 7, pp. 680–689, Jul. 1981.

*Primary Examiner*—Paul Gensler

*Attorney, Agent, or Firm*—Edward B. Anderson

[57] ABSTRACT

The disclosed coupler is in a spiral form having approximately $1\frac{1}{4}$ turns and a length of just over $\frac{1}{4}$ wavelength of a designed frequency. The coil includes an interdigitated section with two conductor portions for each conductor. In the overlapped turn portion, the inner conductors are narrower than the outer conductor. Further, conductor pads are disposed adjacent the coupler conductors for connection to associated couplers to vary the bandwidth of the coupler.

25 Claims, 5 Drawing Sheets

FIG. 7
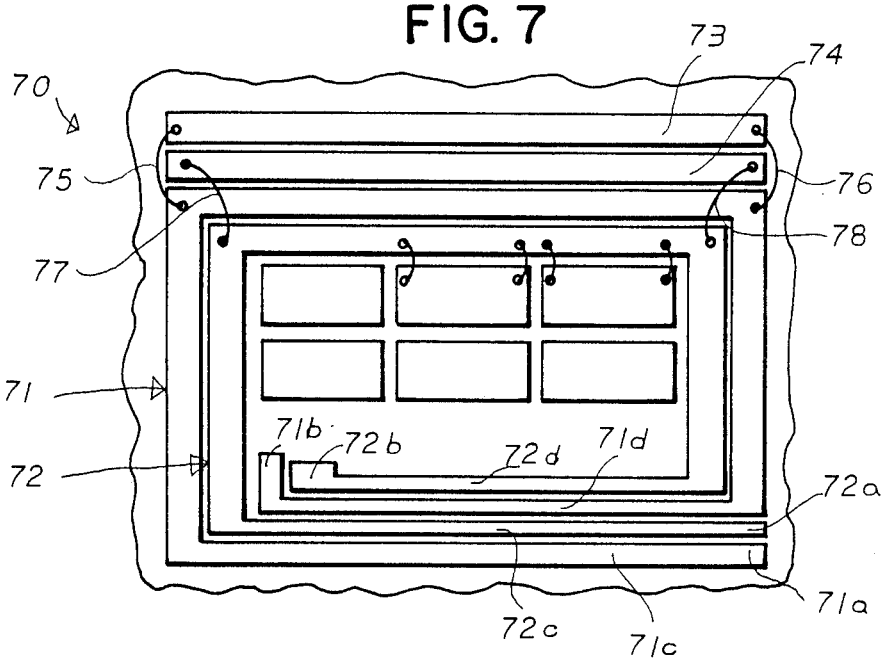
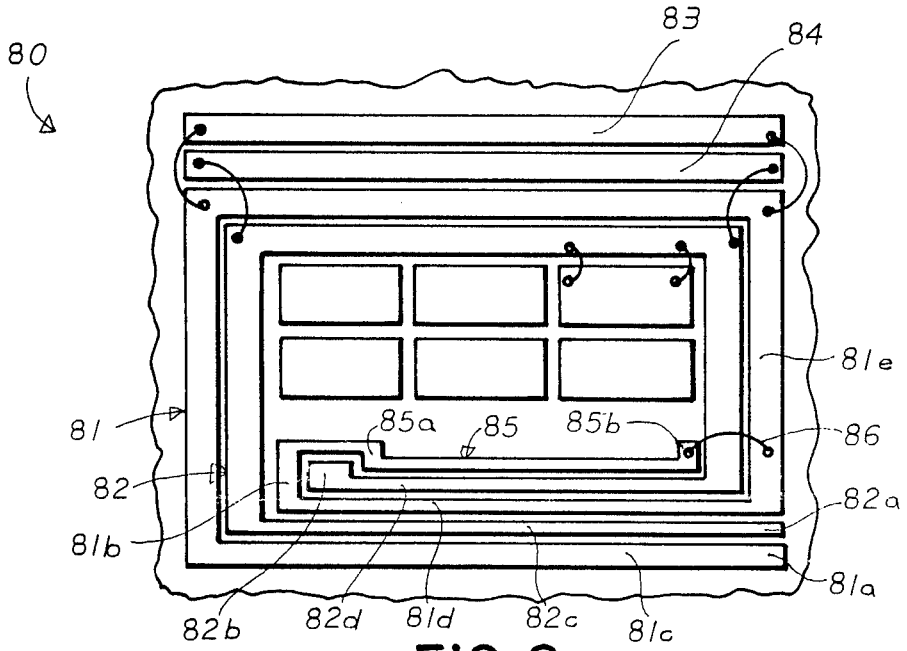
FIG. 8

SPIRAL HYBRID COUPLER

BACKGROUND AND SUMMARY OF THE INVENTION

This invention relates to quadrature couplers, and particularly, to such couplers in the form of a spiral having at least a portion of the outer conductor with a wider width than inner conductors or interdigitation of portions of the spiral lengths.

As the size of microwave integrated circuits have become substantially reduced in recent years, particularly in the microwave industry in which monolithic integrated circuits are becoming increasingly common, a small-sized quadrature coupler is needed. Early developments included an interdigitated strip line coupler and variations of it, such as are described in U.S. Pat. Nos. 3,516,024, issued to Lange; 4,636,754, issued to Presser et al.; and in Kemp et al., "Ultra-Wide Band Quadrature Coupler", *Electronics Letters*, vol. 19, no. 6, pp. 197–199, Mar. 17, 1983. These couplers are a quarter-wavelength long for a single section and require additional space for multisection couplers.

In order to obtain a coupler of even further reduced size, a spiral coupler was developed by Schibata et al., as described in "Microstrip Spiral Directional Coupler", *IEEE Transactions on Microwave Theory and Techniques*, vol. MTT-29, no. 7, July 1981, pp. 680–689. This coupler is formed by coiling two edge-coupled conductors either as two continuous conductors coiled in 1½ or 2 turns, or by connected conductor portions which are coiled and connected by jumper wires to form an equivalent number of turns. These couplers use conductors which are all of identical width and require a gap length of ¾ of a wavelength of a selected design frequency to achieve a 3 dB level of coupling. However, because of the coil configuration they are able to achieve a reduced size as compared to straight strip line couplers. However, as suggested by Shibata et al., the couplers are only good up to a limited frequency, such as three GHz.

The present invention overcomes the limitations of these known devices. For instance, the invention provides a spiral coupler which has a gap length approximately equal to the gap length of the straight strip line couplers, but is substantially smaller. The invention provides a coupler which provides for extended bandwidth over a higher frequency range than spiral couplers have heretofore provided. Further, the gap spacing of the coupler provided by the present invention does not have to be as narrow as is required in prior known spiral couplers for the same frequency range and performance.

More particularly, the present invention provides a spiral coupler made by forming a pair of coiled microstrip conductor lines on a substrate. The two spiral strip conductors are disposed generally in parallel, coplanar, and coextensive spirals. Four alternating coupled regions are formed comprising a first region and a third region in which the inner strip conductor and outer strip conductor are weakly coupled. A second region is disposed between the first and third regions in which the inner strip conductor and outer strip conductor are in the form of an interdigital arrangement of four strongly coupled conductor sections with adjacent sections connected to a different one of the inner and outer strip conductors. A fourth region is disposed between the third and first regions of strong coupling, wherein the beginning and ending portions of the coupled inner and outer strip conductors are adjacent each other as four generally parallel conductor ending portions. These parallel portions have widths less than the widths of the inner and outer strip conductors in the first and third regions.

Further, the present invention provides means for varying the bandwidth of the coupler after it has been constructed. In the preferred embodiment, this is comprised of conductors disposed as islands adjacent to the continuous spiral conductors. Jumper wires may be connected at spaced locations between one of the spiral conductors and one or more of the pads for varying the effective length of the conductors. These pads may be selectively coupled to the spiral conductors in order to obtain a desired bandwidth narrower than the design bandwidth of the coupler without use of such pads.

Such a coupler provides an extended and higher bandwidth at a reduced size as compared to previously known devices. These and other features and advantages of the present invention will be more clearly understood from a consideration of the drawings and the following detailed description of the preferred embodiment.

BRIEF DESCRIPTION OF THE DRAWINGS

FIGS. 7–11 show views similar to that of FIG. 1 of alternative embodiments.

DETAILED DESCRIPTION OF THE PREFERRED EMBODIMENT

Figure 1:
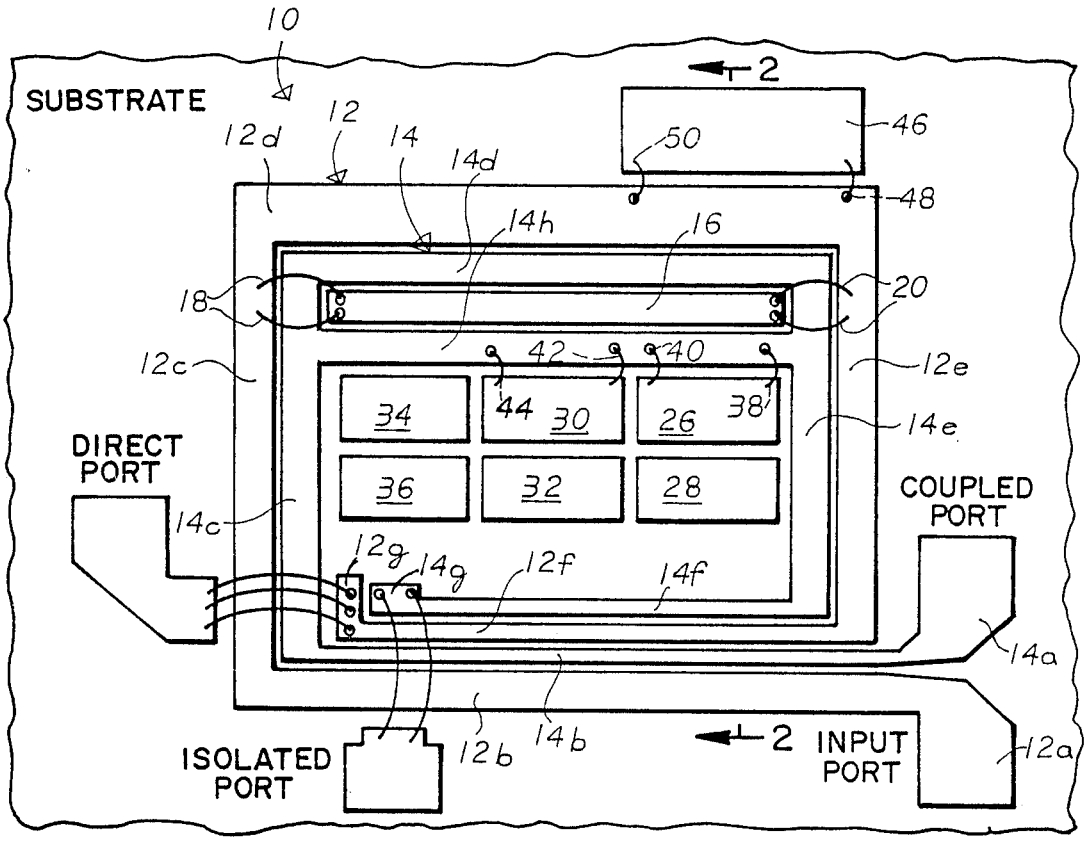
FIG. 1 is a plan view of a preferred embodiment made according to the present invention.
Figure 2:
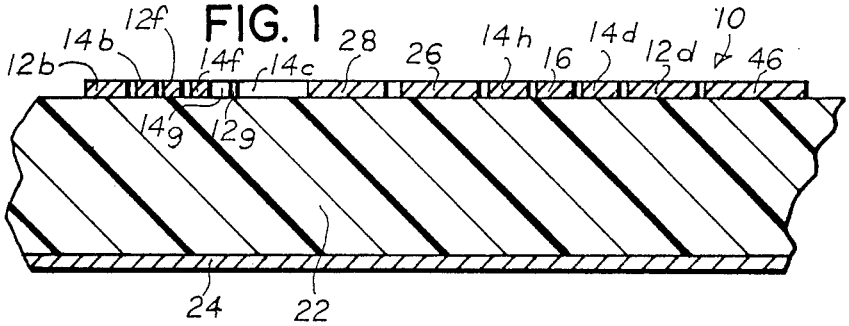
FIG. 2 is a cross sectional view taken along line 2—2 of FIG. 1.

Referring initially to FIGS. 1 and 2, a 3 dB 90 degree quadrature hybrid coupler 10 made according to the present invention is shown. Coupler 10 comprises primarily a first or outer conductor 12 and a second or inner conductor 14. Conductor 12 extends from what would typically be used as an input port **12*a* along consecutive straight sections 12*b*, 12*c*, 12*d*, 12*e* and 12*f*. Conductor 12 terminates in a direct port 12*g* disposed inside the loop. Section 12*f* parallels section 12*b*. Similarly, inner conductor 14 includes a coupled port 14*a*** and respective sections 14*b*–14*f*, paralleling corresponding portions of conductor 12. Conductor 14 terminates at an inside, isolated port **14*g***.

Conductor 14 includes a second spaced conductor portion **14*h* parallel to section 14*d*. Extending between conductor portions 14*d* and 14*h* is an island conductor strip 16 which parallels and has the same width as the adjacent conductor sections of conductor 14. The ends of conductor strip 16 are connected to adjacent portions of conductor 12 by tweaks or jumper wire pairs 18 and 20**.

The width of conductor section **12*b* is approximately 6 mil wide and conductor sections 14*b*, 12*f* and 14*f*** are approximately half that, or 3 mil wide. The width of each of these narrow strips is less than that of a 50 ohm line on the dielectric substrate.

As shown in FIG. 2, conductors 12, 14 are preferably fabricated on a substrate 22 of gallium arsenide, alumina ceramic or other suitable material. A continuous ground plane 24 covers the opposite or bottom face of substrate 22.

Similarly, portion 12*d* is approximately 10 mil wide and conductor portions 14*d*, 16 and 14*h* are each approximately 5 mil wide. There is a gap of approximately 1 mil between the various conductor sections. The total gap length between conductors 12 and 14 is approximately 0.28 times the wavelength of the design frequency of 5 GHz, or approximately 240 mils.

The use of the multiple conductors in the region of conductor section 12*d* increases the effective coupling capacitance of the conductor gap, as does the overlapped portion in the region of conductor section 12*b*.

Additionally, having the outer conductor, such as sections 12*b* or 12*d*, wider causes more current to flow along the edges of these conductors as compared to the narrower conductors. This results in greater coupling between the larger conductor and the substrate ground. Varying the width of conductor 12*b* or 12*d* allows the impedance of the coupler to be set with minimal impact on the level of coupling between conductors 12 and 14. The narrower conductors effectively raise the even mode impedance of the coupled line, which has the effect of increasing the inter-line coupling. Conductor sections 12*c*, 14*c* and sections 12*e*, 14*e*, provide delay between the adjacent connected opposite conductor portions.

The conductor sizing of this preferred embodiment results in four regions of alternating strong and weak coupling. For the purposes of this application, a strongly coupled region has a coupling coefficient, C, greater than 0.3. Correspondingly, a weakly coupled region has a coupling coefficient less than 0.3. The region associated with conductor portions 12*b*, 14*b*, 12*f*, 14*f* and the region associated with portions 12*d*, 14*d*, 14*h* and conductor strip 16 are strongly coupled. The other two regions associated with portions 12*c*, 14*c* and with portions 12*e*, 14*e* are weakly coupled.

Disposed in the inside of the coil of coupler 10 are six conductor pads 26–36. These pads are approximately 10 mil×20 mil in size. They may each, selectively, be connected at spaced locations to one of conductor 16 and conductor section 14*h* of coupler 10. For instance, inner conductor pad 26 was connected to conductor section 14*h* by jumper wire pairs 38 and 40 shown in dashed lines. Similarly, pad 30 was connected to the same conductor at spaced locations by jumper wire pairs 42 and 44, as shown.

Adjacent conductor section 12*d* is a larger outer conductor pad 46 which is approximately 15 mil ×40 mil in dimension, as viewed in FIG. 1. Similarly, pad 46 was connected to conductor section 12*d* by jumper wire pairs 48 and 50. As will be explained, the addition of conductor pads 26, 30 and 46 to conductors 12 and 14 resulted in a narrowing of the bandwidth of the coupler. The pads may be connected in various combinations to increase the capacitance and make the conductors effectively longer, thereby reducing the frequency and/or coupling.

Figure 3:
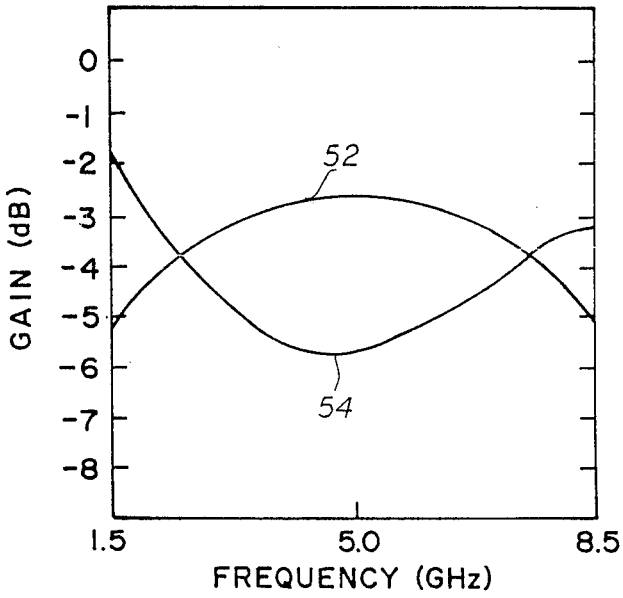
FIG. 3 is a plot of signal transmission magnitude as a function of frequency for the coupler of FIG. 1.

The performance of coupler 30 will now be described. FIG. 3 illustrates the gain associated with coupler 10 without the connection of any conductor pads 26–36. The lower curve 54 represents the gain on the direct port 12*g* when an input signal is input on port 12*a*. Correspondingly, the upper curve 52 illustrates the gain on the coupled port 14*a*. Isolated port 14*g* has a characteristic impedance connected to it, which in the preferred embodiment is 50 ohms.

Figure 4:
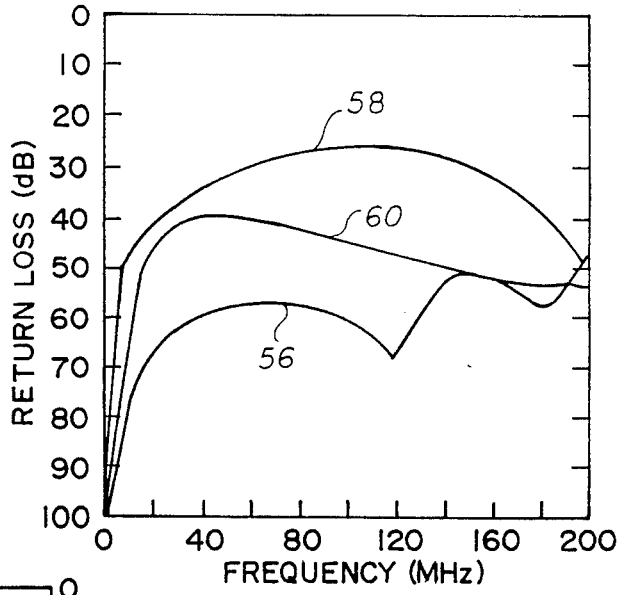
FIGS. 4 and 5 are plots of selected operating parameters as a function of frequency of an enlarged scale model of the coupler of FIG. 1.

FIG. 4 shows the isolation and return loss of a coupler which was built at 40 times the size of coupler 10 described above. Thus, it has a frequency range, as shown in FIG. 4, approximately 1/40 that of coupler 10. However, the isolation and return loss were observed to be very similar for the two couplers. As can be seen, curve 56 shows the return loss to be at least 40 dB for the bandwidth shown. The isolation scale is represented by the right vertical axis. Curve 58 represents the isolation with the input applied to the outer conductor at 12*a* and curve 60 represents the isolation with the input applied to the inner conductor at 14*a*, which is seen to be an improvement over curve 58.

Figure 5:
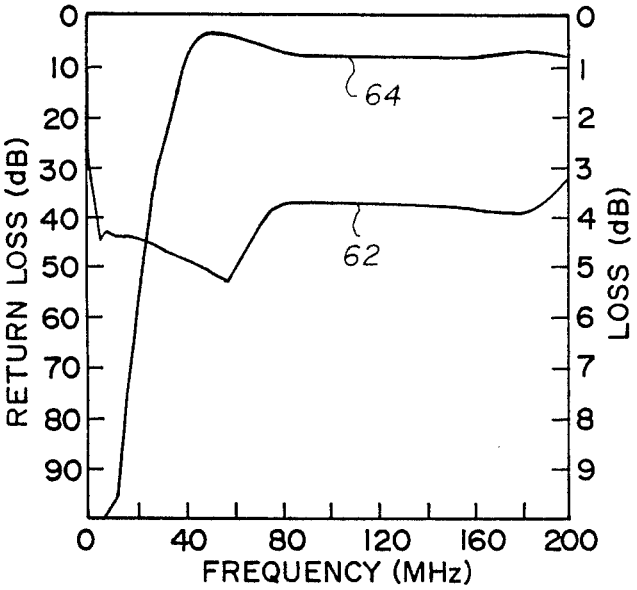

FIG. 5 shows the return loss on curve 62 and double the loss of the coupler on curve 64 when direct port 12*g* and coupled port 14*a* are open circuited with the input applied to input port 12*a* and the output taken from isolated port 14*g*. Again this was tested on a model of coupler 10 which was 40 times its size.

Figure 6:
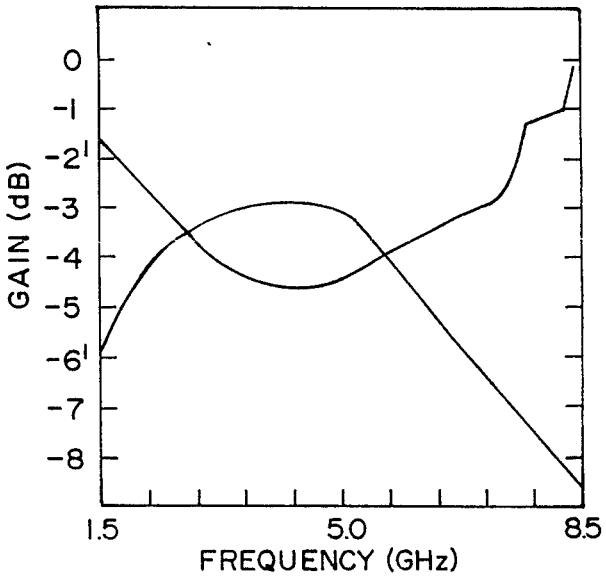
FIG. 6 is a plot of signal transmission magnitude as a function of frequency for a variation of the coupler of FIG. 1.

Referring now to FIG. 6, a plot similar to FIG. 3 is shown. However, for this plot, the coupler included the jumper wires for connecting conductor pads 26, 30 and 46 to the respective conductor sections, as shown by the phantom lines in FIG. 1. As can be seen, the coupler is less overcoupled than was the case with coupler 10. Further, although the lower frequency of the bandwidth is approximately the same, the upper frequency is decreased significantly. Additional pads could be connected in similar or other configurations in order to accomplish further change of the bandwidth and coupling of the coupler.

Couplers are designed for use in particular applications having specified bandwidth frequencies. Thus, it can be seen that with a broad bandwidth coupler, as provided by coupler 10, by adding conductor pads to the associated structure, it is possible to tweak or adjust the coupler to obtain a bandwidth and coupling suited to a particular application. Thus, these pads provide means for varying the bandwidth and coupling of the coupler after it is constructed.

It will further be appreciated that other forms of the structure of this coupler can be provided while accomplishing the same results. For instance, the relative width of the outer conductor compared to those of the inner conductors can be varied to obtain different levels of coupling. Further, the arrangement of the four parallel conductor sections associated with outer conductor section 12*d* can be varied while accomplishing the same results.

Other exemplary embodiments of the invention are shown in FIGS. 7–11. The coupler 70 shown in FIG. 7 is similar to that shown in FIG. 1 in that the outer conductor 71 and inner conductor 72 are similarly constructed. An outer conductor 71 has an input port 71*a* and a direct port 71*b*. It also has a section 71*c* connected to input port 71*a* which is coextensive with the end section 71*d* which terminates in direct port 71*b*. Inner conductor 72 has a coupled port 72*a* and an isolated port 72*b*. An outer coextensive section 72*c* is positioned between corresponding sections 71*c* and 71*d*. An inner coextensive section 72*d* is coupled to port 72*b*.

Instead of the island conductor strip shown with reference to FIG. 1, the embodiment shown in FIG. 7 has a pair of parallel conductor strips 73 and 74. Conductor strip 73 is connected at opposite ends to corresponding positions of inner conductor 71 by jumpers 75 and 76. Similarly, conductor strip 74 is connected to corresponding portions of inner conductor 72 by jumpers 77 and 78.

In FIGS. 8–11, the inner and outer conductors are given similar reference numerals to those of FIG. 7. For example, the input port for the embodiment of FIG. 8 has the number 81*a* as compared to the number 71*a* for the same item in the embodiment of FIG. 7. These features of the embodiments of these figures are shown but are not specifically described.

Referring now to FIG. 8, a coupler 80 has essentially the same main portions as that shown for the embodiment of FIG. 7, including parallel conductor strips 83 and 84. The difference in this case is that direct port 81*b* of outer conductor 81 is unitarily connected to an end 85*a* of a supplemental conductor strip 85. Strip 85 is parallel with and adjacent to inner coextensive section 82*d*. The strip terminates at its other end 85*b* adjacent to inner conductor 82, as shown. End 85*b* is connected to a corresponding adjacent portion 81*e* of outer conductor 81 by a jumper 86. The extension of the end of the supplemental conductor section produces a bandwidth which is narrower than that shown in FIG. 7.

Figure 9:
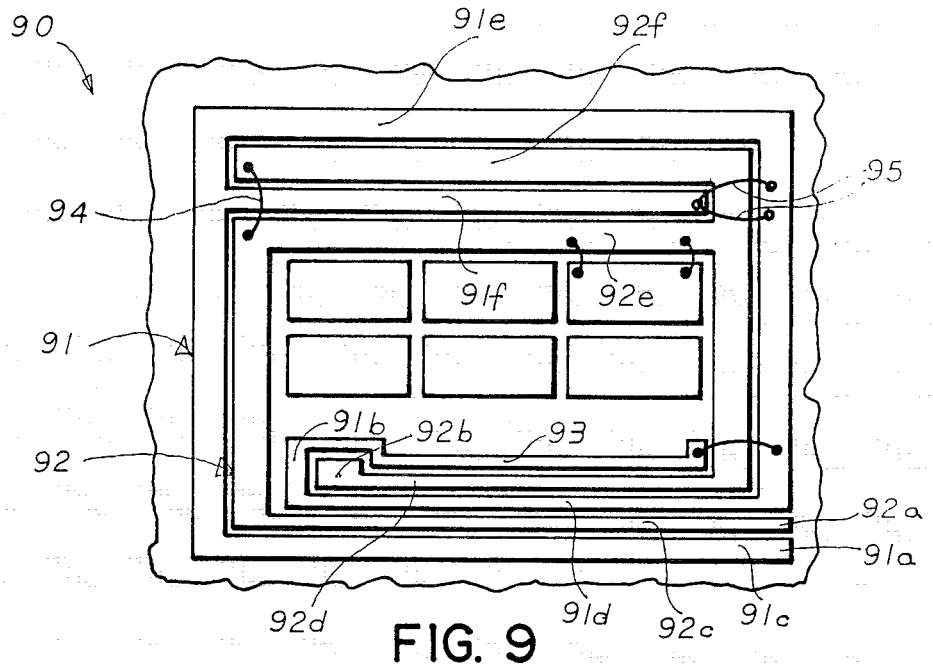

The coupler 90 shown in FIG. 9 is similar in structure to that shown in FIG. 8, including the use of an unitarily-formed supplemental strip conductor 93. The section of interleaved conductors at the top of the figure is formed in part by continuous sections 91*e* and 92*e* of the outer and inner conductors. A strip conductor arm 91*f* is spaced from and parallel with continuous section 91*e*. Similarly, conductor 92 has a corresponding arm 92*f* which is posed between sections 91*e* and 91*f*, with section 91*f* thereby positioned between sections 92*e* and 92*f*. The respective arm ends are coupled to corresponding sections of the same conductor through jumper 94 and jumper pair 95, as shown.

Figure 10:
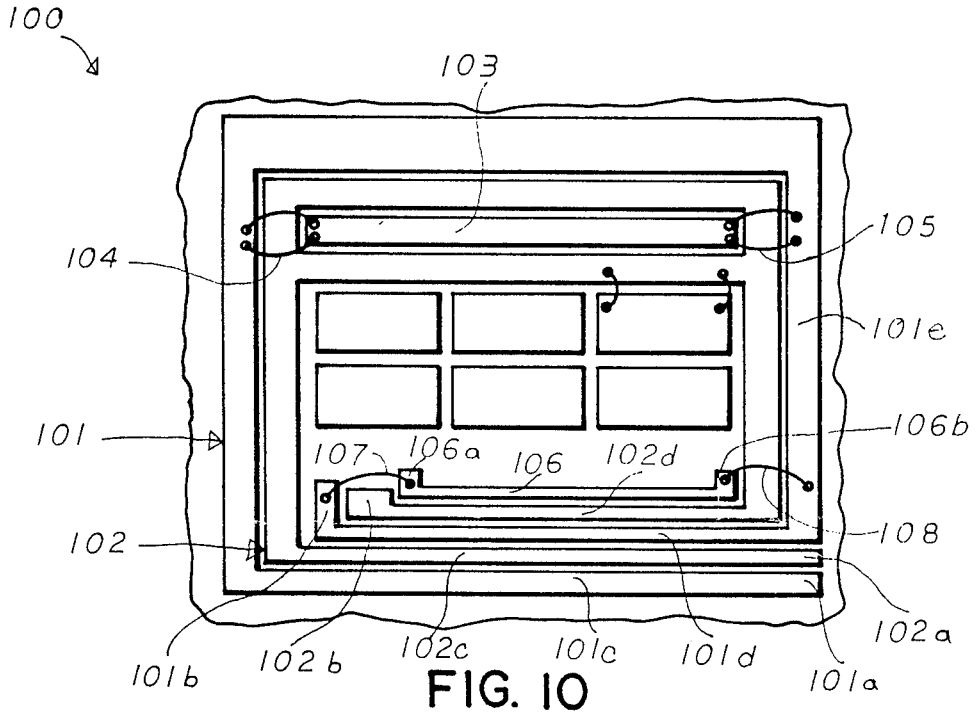

Now referring to the embodiment shown in FIG. 10 as coupler 100, extending parallel with coextensive sections 101*c*, 101*d* and 102*c*, 102*d* is a supplemental strip conductor 106 which is slightly thinner than adjacent conductor section 102*d*. An end 106*a* of conductor 106 is positioned adjacent to isolated port 102*b*. The opposite end 106*b* is positioned at the end of coextensive section 102*d*. End 106*a* is connected to direct port 101*b* by a jumper 107. End 106*b* is connected to a side section 101*e* of outer conductor 101 by a jumper 108, as shown. Supplemental strip conductor 106 provides further structure for tweaking the coupler to obtain a bandwidth and coupling suited to a particular application. In this case, the frequency would be higher than that shown for the embodiment of FIG. 1.

Figure 11:
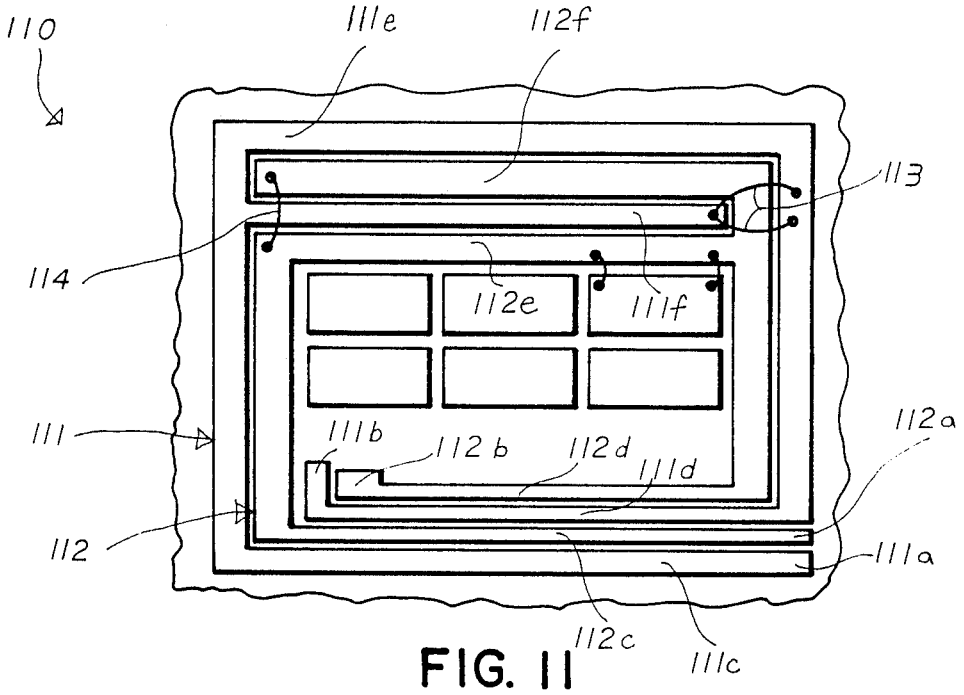

A final embodiment identified as coupler 110 is shown in FIG. 11. Coupler 110 is like coupler 10 described with reference to FIG. 1 with the section of interleaved conductors shown in FIG. 9. More specifically, the interleaved conductors include continuous sections 111*e* and 112*e* and conductor arms 111*f* and 112*f*. The distal end of arm 111*f* is connected to the adjacent continuous section of outer conductor 111 by jumper pair 113. The distal end of arm 112*f* is connected to the adjacent continuous section of inner conductor 112 by jumper 114.

It can be seen that the present invention provides a coupler having a short gap length, only 1¼ turns of conductor strips and a gap width at least twice that of existing state of the art couplers. Such a coupler is compact yet reasonably producible.

While the invention has been particularly shown and described with reference to the foregoing preferred embodiments, it will be understood by those skilled in the art that other changes in form and detail may be made therein without departing from the spirit and scope of the invention as defined in the claims.

We claim:

1. A quadrature coupler having input, direct, coupled and isolated ports comprising:

an outer strip conductor formed in a planar spiral; and an inner strip conductor extending generally parallel, coplanarly and coextensively inside the spiral of, and spaced from said outer strip conductor, said respective conductor ends forming said four ports, four alternating coupled regions comprising a first region and a third region in which said inner strip conductor and outer strip conductor are of known widths and are weakly coupled, a second region disposed between said first and third regions in which said inner strip conductor and outer strip conductor are in the form of an interdigital arrangement of four strongly coupled conductor sections, with adjacent sections connected to a different one of said inner and outer strip conductors, and a fourth region disposed between said third and first regions of strong coupling, wherein the beginning and ending portions of said coupled inner and outer strip conductors are adjacent each other as four generally parallel conductor ending portions with widths less than the widths of said inner and outer strip conductors in said first and third regions.

2. A coupler according to claim 1 wherein the adjacent edges of said conductors define a gap having a length less than one-third the wavelength of a selected center frequency.

3. A coupler according to claim 1 wherein said beginning parallel ending portion of said outer conductor is wider than said other associated parallel conductor ending portions.

4. A coupler according to claim 3 wherein each of said other associated parallel conductor ending portions have substantially equal widths.

5. A coupler according to claim 4 wherein the width of said other associated parallel conductor ending portions are generally half the width of said beginning parallel ending portion of said outer conductor.

6. A coupler according to claim 1 wherein one portion of one of said conductors in said second region extends in two, generally parallel, spaced portions connected at both ends, with said other conductor extending in the space between said spaced portions.

7. A coupler according to claim 6 wherein said other conductor also extends in two, generally parallel spaced portions with one of each of said spaced portions of each of said conductors extending in the space between said spaced portions of said other conductor.

8. A coupler according to claim 7 wherein at least one end of one of said spaced portions of one of said conductors disposed between spaced portions of the other of said conductors is surrounded in the plane of said conductors by the other conductor, said coupler further including conductive jumper means for connecting said surrounded conductor portion end to an adjacent portion of the same conductor.

9. A coupler according to claim 8 wherein both ends of said one spaced portion are surrounded in the plane of said conductors by said other conductor, thereby forming an island in said other conductor.

10. A coupler according to claim 6 wherein said outer spaced portion is wider than said other, inner conductor portions.

11. A coupler according to claim 1 which further includes conductor extension means disposed adjacent to at least one of said conductors and selectably joinable to said conductors for varying the band width of said coupler.

12. A coupler according to claim 11 wherein said extension means comprises at least one conductor pad joinable to one of said conductors at spaced locations by conductor jumper means.

13. A coupler according to claim 12 wherein said extension means comprises a plurality of said pads spaced from each other, said pads being joinable to ones of said conductors at spaced locations by conductor jumper means.

14. A coupler according to claim 1 wherein said outer strip conductor has a width greater than the width of said inner conductor which is adjacent said outer strip conductor, over at least a portion of the length of said conductors.

15. A coupler according to claim 1 wherein the widths of said four conductor ending portions are less than that of a fifty ohm line.

16. A quadrature coupler having input, direct, coupled, and isolated ports comprising:

an outer strip conductor formed in a planar spiral;

an inner strip conductor extending generally parallel, coplanarly and coextensively inside the spiral of, and spaced from said outer strip conductor, said respective conductor ends forming said four ports; and conductor extension means disposed adjacent to at least one of said conductors and selectably joinable to one of said conductors for varying the bandwidth of said coupler.

17. A coupler according to claim 16 wherein said extension means comprises at least one conductor pad joinable to one of said conductors at spaced locations by conductor jumper means.

18. A coupler according to claim 17 wherein said extension means comprises a plurality of said pads spaced from each other, and joinable respectively, to ones of said conductors at spaced locations by conductor jumper means.

19. A quadrature coupler having input, direct, coupled, and isolated ports comprising:

an outer strip conductor formed in a planar spiral; and an inner strip conductor extending generally parallel, coplanarly and coextensively inside the spiral of, and spaced from said outer strip conductor, said respective conductor ends forming said four ports;

wherein one portion of one of said conductors extends in two, generally parallel, spaced portions connected together at both ends, with said other conductor extending in the space between said spaced portions.

20. A coupler according to claim 19 wherein said other conductor also extends in two, generally parallel spaced portions with one of each of said spaced portions of each of said conductors extending in the space between said spaced portions of said other conductor.

21. A coupler according to claim 20 wherein at least one end of one of said spaced portions of one of said conductors is disposed between spaced portions of the other of said conductors and is surrounded in the plane of said conductors by the other conductor, and is connected to an adjacent portion of the same conductor by conductive jumper means.

22. A coupler according the claim 21 wherein both ends of said one spaced portion are surrounded in the plane of said conductors by said other conductor, thereby forming an island in said other conductor.

23. A coupler according to claim 19 wherein the outer spaced portion is wider than said other, inner conductor portions.

24. A quadrature coupler having input, direct, coupled, and isolated ports comprising:

an outer strip conductor formed in a planar spiral; and an inner strip conductor extending generally parallel, coplanarly, and coextensively inside the spiral of, and spaced from said outer strip conductor, said respective conductor ends forming said four ports;

said conductors each forming more than a single turn and the outer stretch of said outer conductor, which is coextensive with a corresponding inner stretch of said outer conductor, is wider than said adjacent stretch of said inner conductor and is wider than said corresponding inner stretch of said outer conductor;

said conductors further including a stretch wherein one of said conductors extends in two, generally parallel spaced portions connected together at both ends with said other conductor extending in the space between said parallel portions.

25. A coupler according to claim 24 which further includes conductor extension means disposed adjacent at least one of said conductors and selectably joinable to one of said conductors for varying the bandwidth of said coupler.

* * * * *